US008413982B2

(12) United States Patent
Honda et al.

(10) Patent No.: US 8,413,982 B2
(45) Date of Patent: Apr. 9, 2013

(54) CONVEYER AND IMAGE FORMING APPARATUS INCLUDING THE SAME

(75) Inventors: Haruyuki Honda, Osaka (JP); Hiroshi Fujiwara, Osaka (JP); Kazuyoshi Kondo, Osaka (JP); Toshikane Nishii, Osaka (JP); Mizuna Tanaka, Osaka (JP); Tomoyoshi Yamazaki, Osaka (JP)

(73) Assignee: Ricoh Company Limited, Tokyo (JP)

( * ) Notice: Subject to any disclaimer, the term of this patent is extended or adjusted under 35 U.S.C. 154(b) by 298 days.

(21) Appl. No.: 12/805,986

(22) Filed: Aug. 27, 2010

(65) Prior Publication Data

US 2011/0058873 A1 Mar. 10, 2011

(30) Foreign Application Priority Data

Sep. 4, 2009 (JP) ..... 2009-204726
May 19, 2010 (JP) ..... 2010-115299

(51) Int. Cl.
*B65H 29/70* (2006.01)

(52) U.S. Cl.
USPC ..... 271/188

(58) Field of Classification Search ..... 271/188
See application file for complete search history.

(56) References Cited

U.S. PATENT DOCUMENTS 5,933,697 A * 8/1999 Onodera et al. ..... 271/188
6,619,657 B2 * 9/2003 Horikoshi et al. ..... 271/188
6,965,750 B2 * 11/2005 Muratani ..... 271/188
2006/0153624 A1 7/2006 Maeda et al.
2009/0214278 A1 8/2009 Kawachi et al.

FOREIGN PATENT DOCUMENTS

JP 6-183628 7/1994
JP 9-240900 9/1997
JP 2006168940 A 6/2006
JP 2008-127199 6/2008
JP 2009263098 A 11/2009

OTHER PUBLICATIONS

Chinese Office Action dated Aug. 31, 2012, issued in corresponding Chinese Patent Application No. 201010275908.5 and English translation thereof.

* cited by examiner

*Primary Examiner* — Gerald McClain
(74) *Attorney, Agent, or Firm* — Harness, Dickey & Pierce, P.L.C.

(57) ABSTRACT

A conveyer includes a first rotating body; a second rotating body pair; and an intermediate rotating body arranged between the first rotating body and the second rotating body pair. A curl of the recording medium is corrected by winding and bending the recording medium around and with the intermediate rotating body at a bent angle formed by a tangent line shared by the intermediate rotating body and the first rotating body, and a line on which such a tangent line of the intermediate rotating body is connected to a nip point of the second rotating body pair. The intermediate rotating body includes an escape mechanism that is capable of causing the intermediate rotating body to escape in a direction to increase the bent angle depending on the width of the recording medium.

9 Claims, 11 Drawing Sheets

Fc>Fa

Fc>Fa

CONVEYER AND IMAGE FORMING APPARATUS INCLUDING THE SAME

CROSS-REFERENCE TO RELATED APPLICATIONS

The present application claims priority to and incorporates by reference the entire contents of Japanese Patent Application No. 2009-204726 filed in Japan on Sep. 4, 2009 and Japanese Patent Application No. 2010-115299 filed in Japan on May 19, 2010.

BACKGROUND OF THE INVENTION

1. Field of the Invention

The present invention relates to a conveyer for correcting a curl of a recording medium formed in an image forming apparatus such as a printer, a copier, a facsimile, or a printer, and to an image forming apparatus including the conveyer.

2. Description of the Related Art

By a method often adopted in known image forming apparatuses, a developing unit develops an electrostatic latent image that is formed on an image carrier into a toner image by using a laser or a light emitting diode (LED) array, for example, then the toner image is directly or indirectly transferred via an intermediate transfer belt, for example, to a recording medium, such as transfer paper, as an unfixed toner image. A fixing unit located downstream in a conveying direction is used to fix the unfixed toner image as a permanent image on the recording medium.

In this type of image forming apparatuses, the fixing unit is used to apply heat and pressure to the recording medium carrying the unfixed toner image, to fix the unfixed toner image onto the recording medium. However, upon fixing the unfixed toner image onto the recording medium, a so-called curl tends to be formed on the recording medium in the direction perpendicular to the conveying direction. Such a curl formed on the recording medium gives negative effects to conveyability of the recording medium conveyed thereafter, and to stackability of recording media in a recording medium ejecting unit such as an ejecting tray. Therefore, various countermeasures for correcting or reducing a curl formed on a recording medium have been invented and implemented in an image forming apparatus.

At the same time, if a curl correction is applied to a strong or a rigid recording medium, such as thick paper, that would not be curled so much in the fixing unit to start with, such a curl correction might have undesirable effects. For example, another type of curls might be formed (for example, a curl along other direction than the one corrected in the curl correcting unit), or the load of conveying the recording medium through the curl correcting means or unit could be increased.

In response to this issue, an invention for automatically omitting the application of a curl correction or adjusting the curl correction when the recording medium is a rigid one, such as thick paper, has been made. This kind of curl correcting unit is disclosed in Japanese Patent Application Laid-open No. 2006-168940.

The curl correcting unit disclosed in Japanese Patent Application Laid-open No. 2006-168940 includes a roller pair, located downstream of a fixing unit in the conveying direction, to correct a curl of a recording medium. One of the roller pair is rotatable around a roller axis of the other roller. Depending on the strength and the rigidity of a recording medium being conveyed, the rotatable roller rotates about the center of the other fixed roller, and co-operates with the form of a conveyance guiding member located downstream of the roller pair in the conveying direction, to automatically apply a curl correction based on the rigidity determined by the thickness of the recording medium, for example.

However, in a curl correcting unit such as one disclosed in Japanese Patent Application Laid-open No. 2006-168940, when the recording medium is thin, the front edge of the recording medium being conveyed is brought into contact with the conveyance guiding member, which is co-operating with and located downstream of the curl correcting roller pair in the conveying direction, at an almost obtuse angle, and as a result, the conveyance guiding member might obstruct conveyance of the recording medium. Consequently, so-called conveyance jamming might occur frequently. At the same time, when the recording medium is rigid like thick paper, one of the roller pair in the curl correcting unit rotates about the other. This might result in an insufficient force for conveying the recording medium, being unable to provide an appropriate conveying force. Moreover, because in such a curl correcting unit, it is difficult to convey a recording medium in a reverse direction. Therefore, the curl correcting unit would have difficulty in supporting a reversing operation of a recording medium, such as one performed upon executing double-sided image formation in which the recording medium is reversed and conveyed. In addition, because the roller pair is used as means for correcting a curl of the recording medium, the curvature radius of the recording medium is reduced while being nipped by the roller pair and being corrected of the curl. Therefore, in an application to a special recording medium, such as a release paper, the release member could be easily peeled off while passing through the roller pair. Therefore, such a technology has a problem in view of supportability for different types of paper strongly demanded by users, as well as in applications in double-sided image formation that is also highly demanded by users.

SUMMARY OF THE INVENTION

It is an object of the present invention to at least partially solve the problems in the conventional technology.

According to an aspect of the present invention, there is provided an conveyer includes: a first rotating body that controls a direction in which a recording medium is conveyed; a second rotating body pair that is arranged downstream of the first rotating body in the direction in which the recording medium is conveyed, and conveys the recording medium while controlling the direction in which the recording medium is conveyed; and an intermediate rotating body arranged between the first rotating body and the second rotating body pair, and being in contact with the recording medium on a side opposing to another side with which the first rotating body is in contact. The recording medium is wound around and bent by the intermediate rotating body at a bent angle formed by a tangent line shared by the intermediate rotating body and the first rotating body, and a line on which such a tangent line of the intermediate rotating body is connected to a nip point of the second rotating body pair. The intermediate rotating body includes an escape mechanism that is capable of causing the intermediate rotating body to escape in a direction to increase the bent angle depending on rigidity of the recording medium.

According to another aspect of the present invention, there is provided an image forming apparatus including a conveyer arranged downstream of a fixing unit in a conveying direction. The conveyer includes: a first rotating body that controls a direction in which a recording medium is conveyed; a second rotating body pair that is arranged downstream of the first rotating body in the direction in which the recording medium is conveyed, and conveys the recording medium while controlling the direction in which the recording medium is conveyed; and an intermediate rotating body arranged between the first rotating body and the second rotating body pair, and being in contact with the recording medium on a side opposing to another side with which the first rotating body is in contact. The recording medium is wound around and bent by the intermediate rotating body at a bent angle formed by a tangent line shared by the intermediate rotating body and the first rotating body, and a line on which such a tangent line of the intermediate rotating body is connected to a nip point of the second rotating body pair. The intermediate rotating body includes an escape mechanism that is capable of causing the intermediate rotating body to escape in a direction to increase the bent angle depending on rigidity of the recording medium.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 3(*b*) is a front view of the recording medium curled along the direction perpendicular to the conveying direction;

FIG. 3(*c*) is a perspective view of the recording medium curled along the direction perpendicular to the conveying direction;

FIG. 5(*b*) is a side view of the recording medium curled along the conveying direction;

FIG. 5(*c*) is a perspective view of the recording medium curled along the conveying direction;

DETAILED DESCRIPTION OF THE PREFERRED EMBODIMENTS

Exemplary embodiments according to the present invention are described below in greater detail with reference to the attached drawings.

Figure 1:
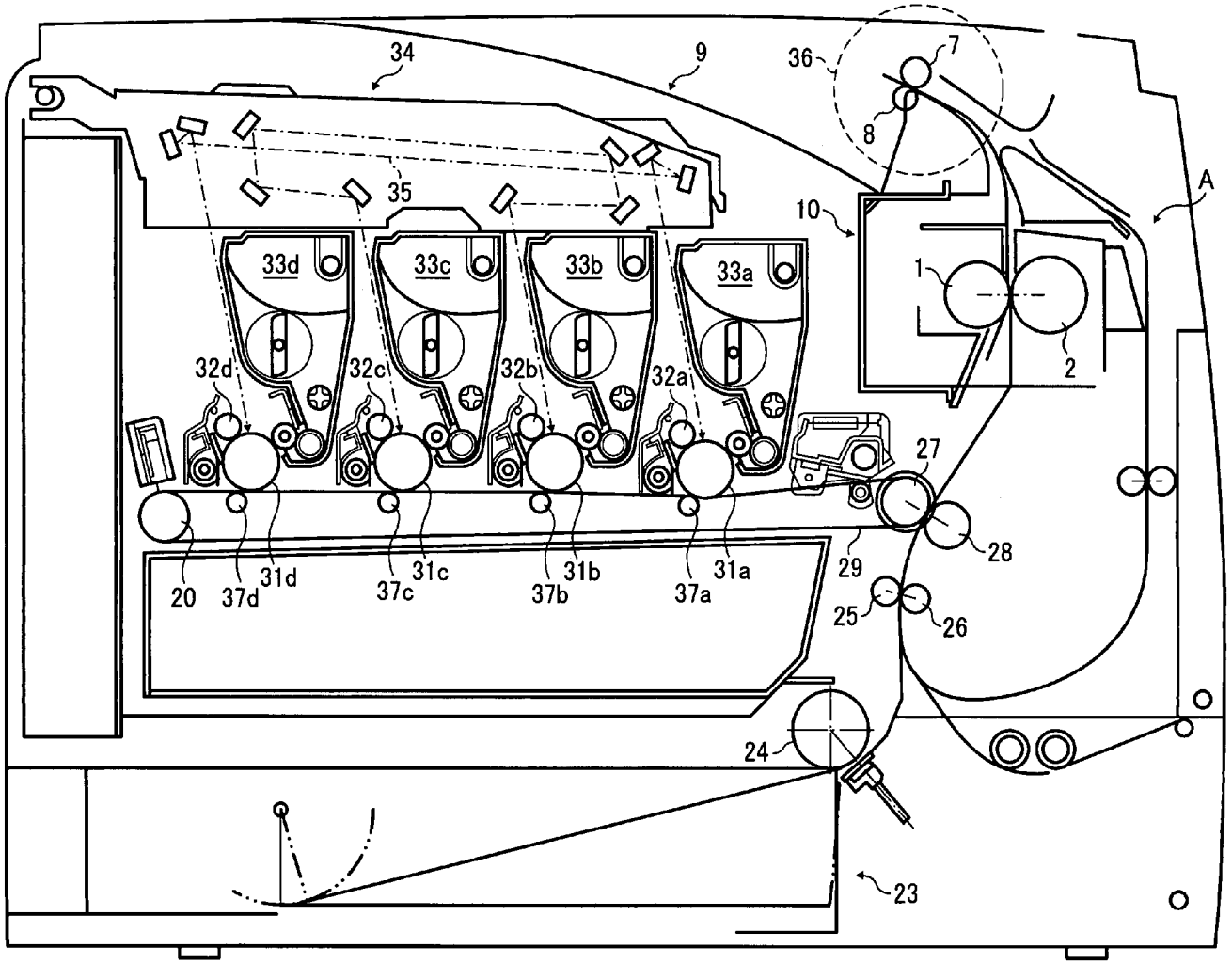
FIG. 1 is a schematic sectional view of an example of an image forming apparatus including a curl correcting unit as a conveyer according to the embodiment.

FIG. 1 is a schematic sectional view of an example of an image forming apparatus in which a curl correcting unit is provided as a conveyer according to the present invention. To begin with, an example of the image forming apparatus including the curl correcting unit according to the present invention, will generally be explained with reference to FIG.

1. In the image forming apparatus illustrated in FIG. 1, four photosensitive bodies, a first to a fourth photosensitive bodies 31*a*, 31*b*, 31*c*, and 31*d*, are arranged at an approximate center of a main body, and a toner image in a different color, for example, a yellow toner image, a magenta toner image, a cyan toner image, and a black toner image, is formed on the photosensitive bodies 31*a*, 31*b*, 31*c*, and 31*d*, respectively.

An intermediate transfer belt 29 that is an intermediate transferring unit having a form of an endless belt, is arranged facing the first to the fourth photosensitive bodies 31*a*, 31*b*, 31*c*, and 31*d*, and each of the photosensitive bodies 31*a*, 31*b*, 31*c*, and 31*d* is arranged to abut to a surface of the intermediate transfer belt 29. The intermediate transfer belt 29 is generally driven to run by spanning a plurality of rollers while coming in either inscribing or circumscribing contact or both with the rollers. In the example illustrated in FIG. 1, the intermediate transfer belt 29 is wound around supporting rollers 20, 27 and the like. The roller 27, which is one of the supporting rollers, is used as a driving roller driven by a driving unit (not illustrated). By way of the driving roller 27 driven in rotation, the intermediate transfer belt 29 rotates in the counterclockwise direction in FIG. 1.

Because structures for forming a toner image on each of the photosensitive bodies 31*a*, 31*b*, 31*c*, and 31*d* in each color, and transferring each of the toner images onto the intermediate transfer belt 29 (primary transfer) are substantially the same, the structures for transferring the toner image onto the intermediate transfer belt 29 will be explained below without symbols a, b, c, and d.

The photosensitive body 31 is driven in rotation in the clockwise direction. At this time, the surface of the photosensitive body 31 is irradiated with light output from a neutralizing unit, which is not illustrated, and initialized. The initialized photosensitive body surface is uniformly charged to a predetermined polarity by a charging roller 32. The charged surface is irradiated with an optically modulated laser beam 35 emitted from an exposing unit 34, to form an electrostatic latent image corresponding to information written onto the surface of the photosensitive body 31. The electrostatic latent image formed on the photosensitive body 31 is visualized as a toner image while passing through a developing unit 33.

A primary transfer roller 37 is arranged inside of the intermediate transfer belt 29, facing the photosensitive body 31 with the intermediate transfer belt 29 therebetween. A primary transfer nip portion is formed appropriately between the photosensitive body 31 and the intermediate transfer belt 29 when the primary transfer roller 37 is kept in contact with the rear surface of the intermediate transfer belt 29.

A transfer voltage of the opposite polarity to that of charged toner in the toner image formed on the photosensitive body 31 is applied to the primary transfer roller 37. In this manner, a transfer field is created between the photosensitive body 31 and the intermediate transfer belt 29, to primarily and electrostatically transfer the toner image on the photosensitive body 31 to the intermediate transfer belt 29 driven in rotation synchronously with the photosensitive body 31. In this manner, a toner image of each color is formed on each of the photosensitive bodies 31*a*, 31*b*, 31*c*, and 31*d*, and the toner image of each color is superimposed one after another at an appropriate timing on the intermediate transfer belt 29, sequentially from upstream of a direction in which the intermediate transfer belt 29 is conveyed, to form a full-color image.

As illustrated in FIG. 1, a paper feeding cassette 23 that is a recording medium housing unit in which recording media, such as recording paper or sheets, are stacked and housed is provided at the bottom in the main body of the apparatus. One of the stacked recording media starts to be conveyed from the stacked bundle of the recording media, by way of frictional conveying force generated by a rotating feeding roller 24. The recording media is conveyed to registration roller pair 25 and 26 that has not driven to rotate yet, and the recording medium is registered in the registration roller pair 25 and 26.

The registered recording medium is conveyed by the registration roller pair 25 and 26 that is driven to rotate at the timing when the full-color toner image primarily transferred sequentially to the intermediate transfer belt 29 arrives, and the image is secondarily transferred to the recording medium in a secondary transfer nip portion formed by the secondary transfer roller 27, which is also a driving roller, and a facing roller 28. The recording medium having the image secondarily transferred is conveyed to a fixing unit 10 arranged downstream in the direction the recording medium is conveyed. The image is subjected to heat and pressure of a fixing roller 1 and a pressing roller 2 included in the fixing unit 10, and is fixed to the recording medium as a permanent image. The recording medium is then ejected by an ejecting unit 36 including an ejecting roller 7 and an ejection driven roller 8 driven by the ejecting roller 7 into an ejecting tray 9. In this manner, image forming operation is completed.

Figure 2A:
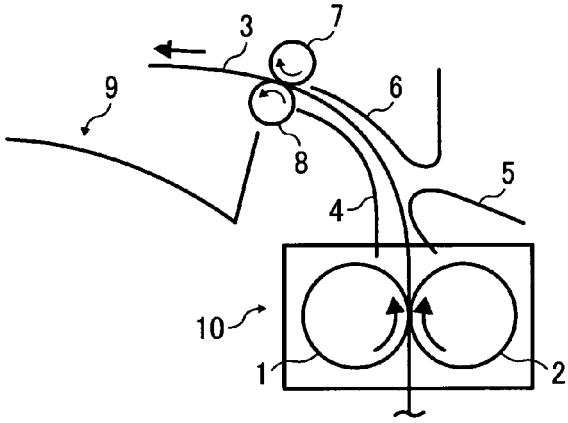
FIG. 2A is an enlarged schematic sectional view of a recording medium conveying path between a fixing unit and an ejecting tray, for explaining the recording medium conveying path used in single-sided image formation in which an image is formed on a single side of a recording medium.
Figure 2B:
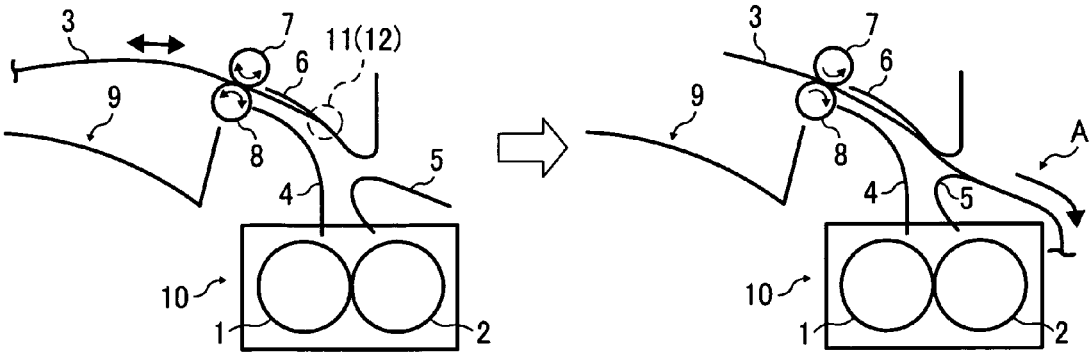
FIG. 2B is an enlarged schematic sectional view of the recording medium conveying path between the fixing unit and the ejecting tray, for explaining the recording medium conveying path used in double-sided image formation in which an image is formed on both sides of a recording medium.

The conveying path located downstream of the fixing unit 10 in the conveying direction will now be explained in greater detail based on FIGS. 2A and 2B. FIGS. 2A and 2B are enlarged schematic sectional views illustrating the path in which the recording medium is conveyed from the fixing unit 10 to the ejecting tray 9. FIG. 2A is a schematic explaining the path where the recording medium is conveyed during single-sided image formation in which an image is formed on one side of the recording medium. FIG. 2B is a schematic explaining the path where the recording medium is conveyed during double-sided image formation in which images are formed on both sides of the recording medium. FIGS. 2A and 2B do not include a curl correcting unit 15 according to the present invention, to allow better understanding of the present invention.

In the single-sided image formation illustrated in FIG. 2A, a recording medium 3 is conveyed to the ejecting roller 7 and the ejection driven roller 8, by the driving rotations of the fixing roller 1 and the pressing roller 2, while being guided by recording medium conveyance guiding members 4, 5, and 6. The recording medium 3 conveyed up to this point is ejected to the ejecting tray 9 by the driving rotation of the ejecting roller 7 rotating in a positive direction, and the ejection driven roller 8 driven to rotate. In the double-sided image formation illustrated in FIG. 2B, the recording medium 3 is conveyed to the ejecting roller 7 and the ejection driven roller 8 by the driving rotation of the fixing roller 1 and the pressing roller 2, while being guided by the recording medium conveyance guiding members 4, 5, and 6, in the same manner as in the single-sided image formation. In the double-sided printing, however, after a sensor not illustrated detects that the rear edge of the recording medium (indicated by the reference numeral 11 in FIG. 2B) has reached a conveying path formed by the recording medium conveyance guiding members 4 and 6, the ejecting roller 7 and the ejection driven roller 8 are driven to rotate in the reverse directions, to convey the recording medium in the reverse direction, with the rear edge 11 of the recording medium as a front edge 12 of the recording medium. By way of the reactive force of the recording medium, the recording medium 3 conveyed in the reverse direction is conveyed along the recording medium conveyance guiding member 6, with the rear edge 11 of the recording medium switched to the front edge 12 of the recording medium. As a result, the recording medium is guided to a double-sided image forming conveying path A, which is illustrated in FIG. 1 as well. The recording medium 3 guided to the double-sided image forming conveying path A is again conveyed to the registration roller pair 25 and 26 (see FIG. 1), has an image transferred onto the rear side, in the same manner as an image being formed on one side, is conveyed via the fixing unit 10, and is ejected to the ejecting tray 9.

Figure 3:
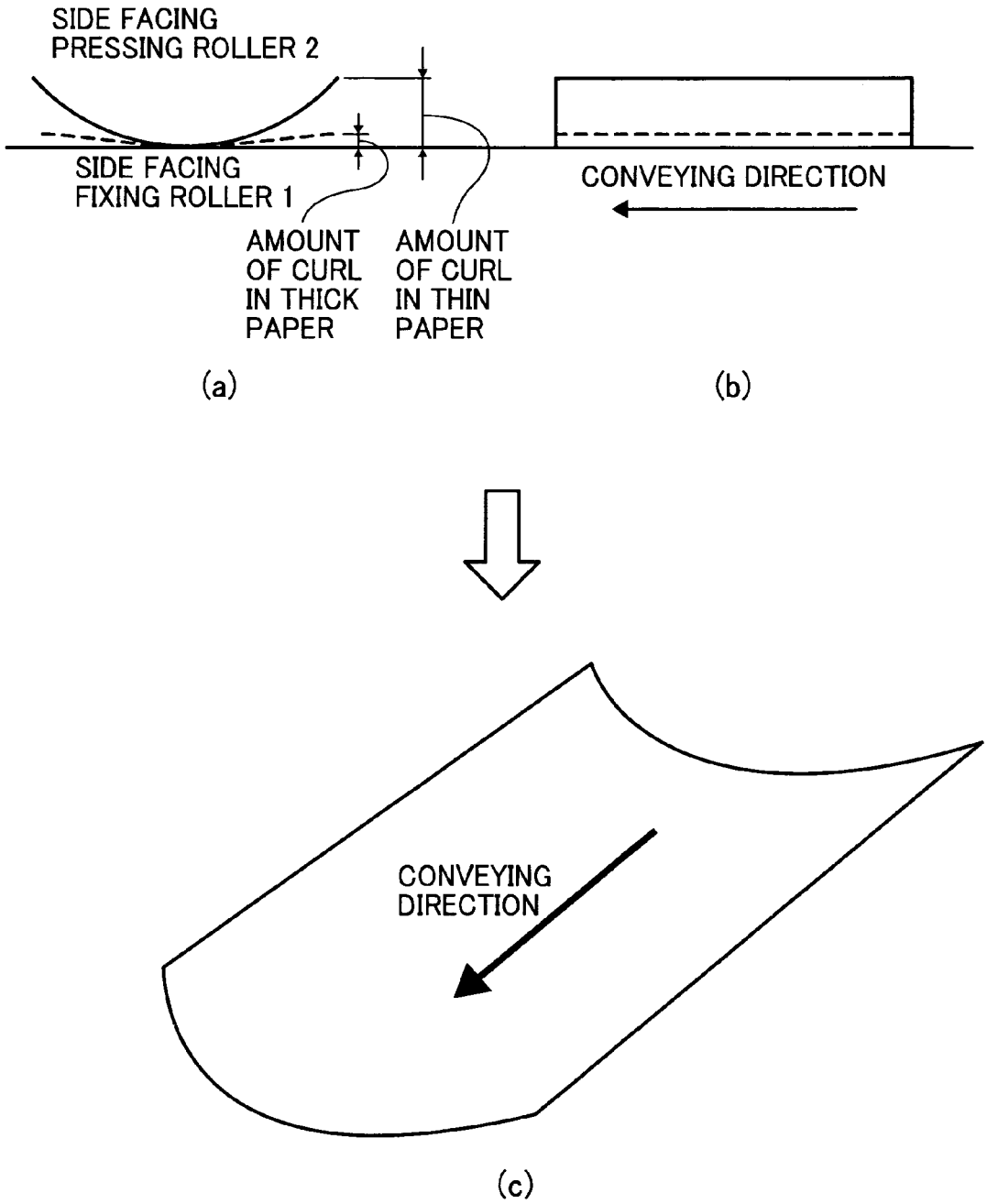
FIG. 3(*a*) is a side view of a recording medium curled along a direction perpendicular to a conveying direction.

The recording medium 3 having the image formed tends to curl along the pressing roller 2 in the direction of the recording paper in parallel with the conveying direction of the recording medium, as illustrated in FIG. 3, although the curl depends on how fibers are arranged in the recording medium while the unfixed toner image, which is transferred thereon via the intermediate transfer belt 29, is fixed as a permanent image by way of the heat of the fixing roller 1 and the contact pressure of the pressing roller 2 against the fixing roller 1 in the fixing unit 10. FIGS. 3(*a*), 3(*b*), and 3(*c*) are a front view, a side view, and a perspective view, respectively, of the recording medium 3 curling along the direction perpendicular to the conveying direction.

A curl such as the one illustrated in FIG. 3 is known is to be formed when the fibers in the recording medium 3 are laid in parallel with the conveying direction of the recording medium, and the heated fixing roller 1 is higher in temperature than the pressing roller 2. The fibers in the recording medium 3 are laid in parallel with the conveying direction of the recording medium when the paper is long-grain, in other words, when the fibers are laid along the long-side direction of the recording medium, if the image forming apparatus is an A4 portrait-oriented conveyer, and when the paper is short-grain, in other words, when the fibers are laid in the short-side direction of the recording medium, if the image forming apparatus is an A4 landscape-oriented conveyer. Generally, long-grain paper is used more often than the short-grain paper.

The recording medium 3 curling in the manner illustrated in FIG. 3 may have a negative effect to stackability of the recording media ejected to the ejecting tray 9. For example, the recording medium 3 may push the rear edge of the recording medium that has been previously ejected in the ejecting tray 9 and also curling in the manner illustrated in FIG. 3, forcing the recording medium to fall off from the image forming apparatus. Furthermore, if a curled recording medium is conveyed upon performing double-sided image formation, or conveyed to the ejecting tray 9 using another conveying roller pair, although it is not exactly the same from the example illustrated in FIG. 1, such a curl might prevent the nip portion from nipping the front edge of the recording medium appropriately upon nipping the recording medium between the conveying roller pair, and could become a factor of causing conveyance jamming.

Figure 4:
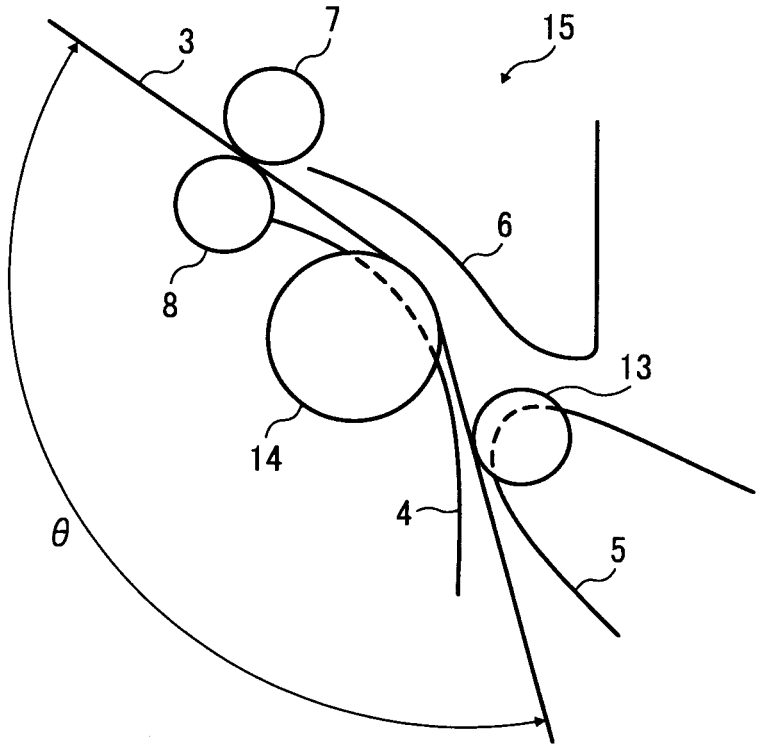
FIG. 4 is a schematic sectional view of a curl correcting unit.

Therefore, a curl such as the one illustrated in FIG. 3 needs to be corrected. In response to this issue, the inventors of the present invention first came up with an idea to correct a curl of the recording medium by using a curl correcting unit 15 whose schematic sectional view is illustrated in FIG. 4. The curl correcting unit 15 illustrated in FIG. 4 is arranged in the image forming apparatus at a position downstream to the fixing unit 10 in the conveying direction, and the recording medium 3 passed through the curl correcting unit 15 is ejected to the ejecting tray 9.

The curl correcting unit 15 illustrated in FIG. 4 includes a first controlling roller 13 that is a first rotating body controlling the direction in which the recording medium 3 is conveyed from the fixing unit 10, the ejecting roller 7 and the ejection driven roller 8 that are a second rotating body pair arranged downstream to the first controlling roller 13 in the conveying direction of the recording medium, and conveying the recording medium while controlling the direction of conveyance of the recording medium, a bending roller 14 that is an intermediate rotating body arranged between the first controlling roller 13 and the ejecting roller 7 and the ejection driven roller 8, and being in contact with the recording medium 3 on the opposite side as the side on which the first controlling roller 13 is in contact with the recording medium 3. The recording medium is wound around and bent by the bending roller 14 at an bent angle formed by a line that is a tangent line shared between the bending roller 14 and the first controlling roller 13, and a line at which the tangent line of the bending roller 14 is connected to the nip point of the ejecting roller 7 and the ejection driven roller 8. In this manner, it is possible to correct and to reduce a curl, such as the one illustrated in FIG. 3, formed in the direction perpendicular to the conveying direction of the recording medium, by offsetting the internal stress in the recording medium. The recording medium is laid in the direction of the line that is the tangent line shared between the bending roller 14 and the first controlling roller 13 (first direction) when the recording medium is conveyed, being in contact or being supported by the first controlling roller 13, the bending roller 14, and the ejection roller 7 and the ejection driven roller 8, while having a curl being corrected thereby. At the same time, the recording medium is laid in the direction of the line at which the tangent line of the bending roller 14 is connected to the nip point of the ejecting roller 7 and the ejection driven roller 8 (second direction). Therefore, the bent angle θ could also be defined as an angle formed by the first direction, which is also the conveying direction of the recording medium from the first controlling roller 13 to the bending roller 14, and the second direction in which the recording medium is conveyed from the bending roller 14 to the ejecting roller 7 and the ejection driven roller 8.

In the example illustrated in FIG. 4, the first controlling roller 13 is arranged rotatably on the conveyance guiding member 5, and the bending roller 14 is arranged rotatably on the recording medium conveyance guiding member (facing guiding member) 4 that faces the recording medium conveyance guiding member (front edge guiding member) 6 guiding the front edge of the recording medium, and being in a pair with the recording medium conveyance guiding member 6, to guide conveyance of the recording medium and to form the conveying path for the recording medium. Furthermore, to simplify the image forming apparatus including the curl correcting unit 15, in the example illustrated in FIG. 4, the ejecting roller 7 and the ejection driven roller 8 are also used as an ejecting roller pair. However, the ejecting roller 7 and the ejection driven roller 8 may also be provided separately from the ejecting roller pair.

In the present invention, the recording medium is wound around the bending roller 14, and the recording medium is forcibly bent in the direction perpendicular to the formed curl, to correct the curl by offsetting the internal stress of the recording medium that is the cause of such a curl. Therefore, the smaller the bent angle θ is, the more effectively the curl is corrected, and the larger the bent angle θ is, the less effective the curl is corrected.

Figure 6:
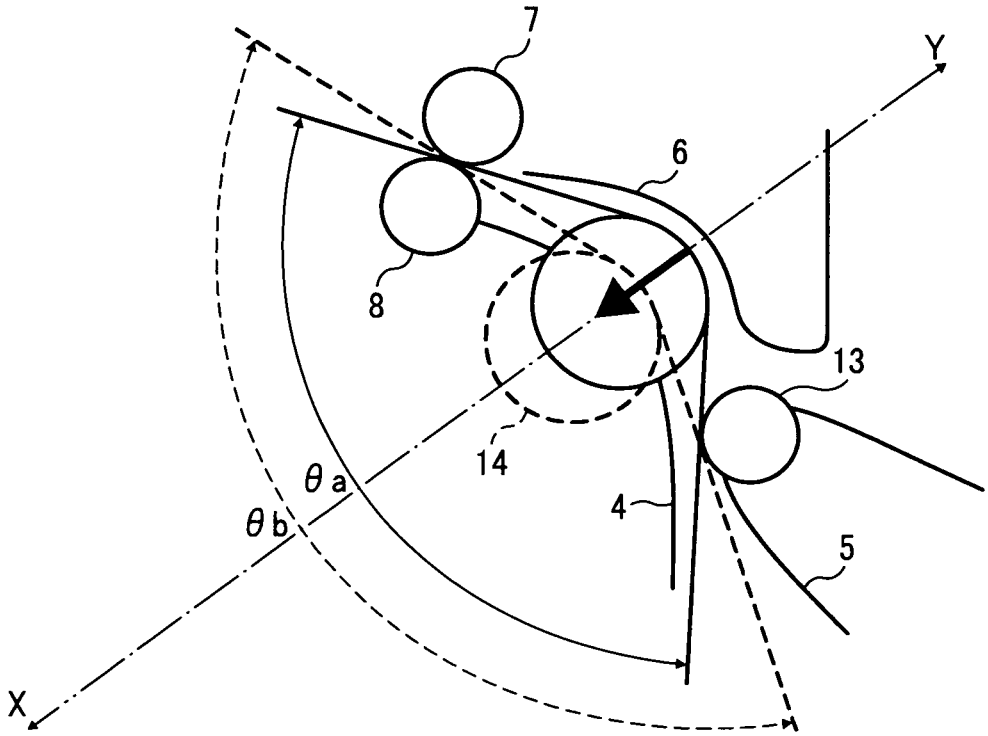
FIG. 6 is a schematic sectional view of a curl correcting unit according to the present invention.

Therefore, upon correcting a curl of a less rigid recording medium, such as thin paper, the curl can be corrected or reduced to a desired level by setting the bent angle θ to a value at which such a curl can be sufficiently corrected (see θa in FIG. 6). The bent angle θa can be set either upon designing the image forming apparatus or the curl correcting unit, or repeating experiment using an actual machine, or both.

Figure 5:
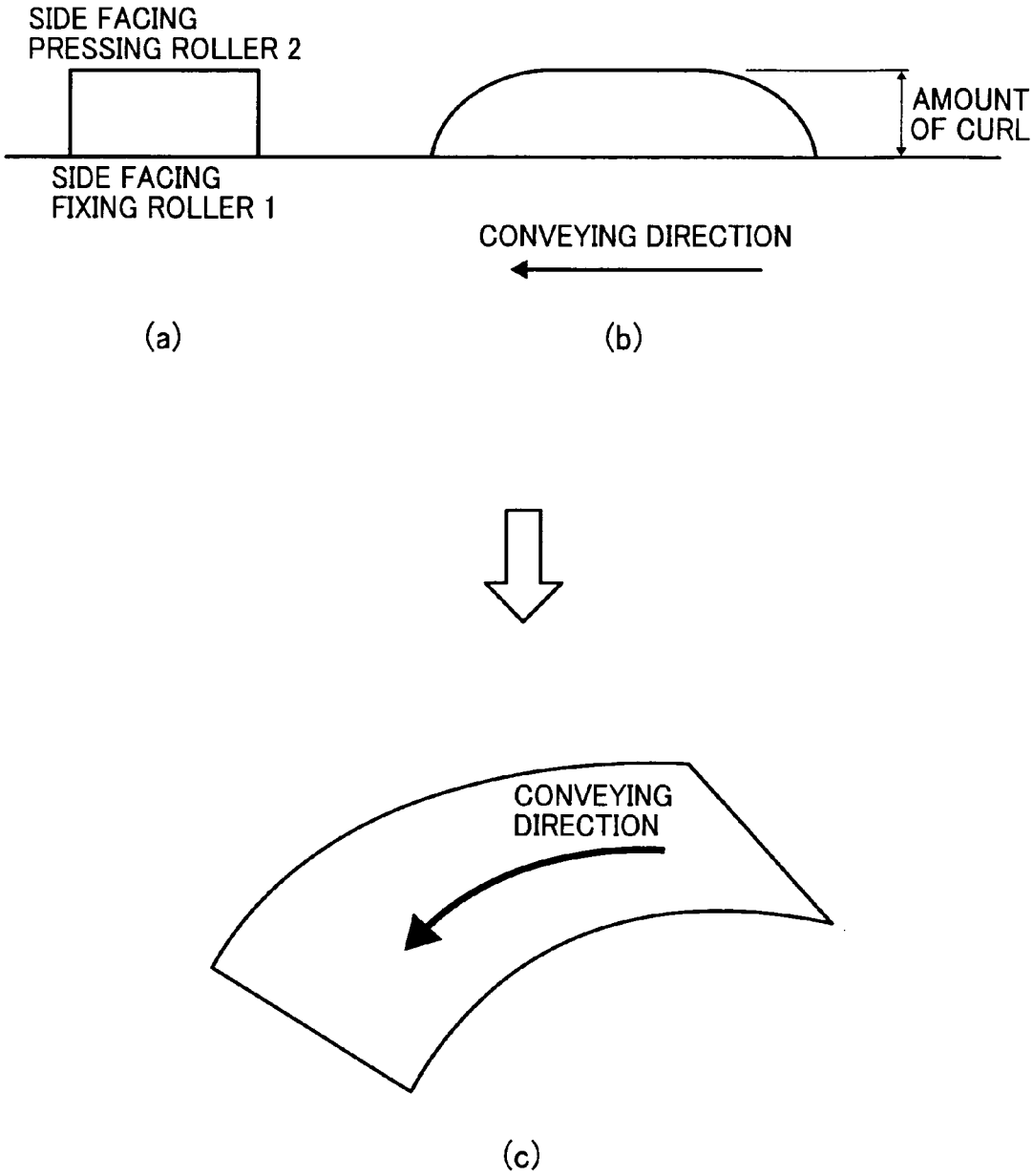
FIG. 5(*a*) is a front view of the recording medium curled along the conveying direction.

On the contrary, if the recording medium is thick as illustrated by a dotted line in FIG. 3, because the recording medium is more rigid due to its thickness, the recording medium would be curled less in comparison with that in thin paper. Generally, the thicker the recording medium is, the more rigid the recording medium is. If the curl of a recording medium such as thick paper curled slightly is corrected using the bent angle θa suitable for correcting a curl of thin paper, the edge of the recording medium could be curled in a direction in perpendicular to the conveying direction toward the fixing roller 1, as illustrated in FIG. 5, because the internal stress to be offset is small. FIGS. 5(*a*) to 5(*c*) are a front view, a side view, and a perspective view, respectively, of the recording medium curled along the conveying direction.

Because a curl such as the one illustrated in FIG. 5 can be a cause of deteriorating the stackability or conveyability of the recording medium, it is necessary to adjust the degree of the curl correction by increasing the bent angle θ for a recording medium such as thick paper. In addition, if the recording medium is rigid like thick paper, it is also preferable to increase the bent angle θ, because the conveyance jamming is more likely to occur when the conveying load in the conveying path where the recording medium is conveyed increases.

In response to this issue, in a curl correcting unit whose schematic side view is illustrated in FIG. 6, the inventors of the present invention invented a curl correcting unit that can automatically adjust the degree of the curl correction depending on the rigidity of the recording medium, by providing the bending roller 14 with an escape mechanism that causes the bend roller to escape in the direction to increase the bent angle θ, in other words, in the direction from θa illustrated in a solid line to θb illustrated in a dotted line, depending on the rigidity of the recording medium.

To facilitate understanding of the present invention, the bending roller 14 is caused to escape in the direction dividing the bent angle θ into two halves, as illustrated in FIG. 6. However, the present invention is not limited thereto. An object of the present invention can be achieved as long as the escape mechanism can cause the bending roller 14 to escape in a direction to increase the bent angle θ depending on the rigidity, such as the thickness, of the recording medium.

In such a structure, the recording medium 3 having its conveyed direction controlled by the first controlling roller 13 and the ejecting roller 7 and the ejection roller 8 are wound around the bending roller 14 at the bent angle θ, to have the curl formed thereon corrected. Therefore, unlike the structure in which a curl is corrected with a roller pair, the curvature radius of the recording medium 3 does not have to be reduced. In addition, by causing the bending roller 14 to escape in the direction to increase the bent angle θ depending on the rigidity of the recording medium 3, the curl correction can be performed automatically depending on the rigidity of the recording medium 3. As a result, a less curled recording medium 3 can be obtained regardless of a type of the recording medium 3, especially regardless of the thickness type of the recording medium 3. Furthermore, because the bending roller 14 is caused to escape in the direction to increase the bent angle of the recording medium 3, the load of conveying the recording medium 3 can be reduced when a highly rigid recording medium, such as thick paper, is conveyed. As a result, a more appropriate conveyance can be achieved, with less jamming in conveying the recording medium 3, as well as an appropriate conveying force ensured by way of the ejecting roller 7 and the ejection driven roller 8. Furthermore, even if the recording medium 3 is conveyed to the curl correcting unit 15 according to the present invention in the reverse direction, because the recording medium 3 is conveyed into the conveying channel A for the double-sided image formation, by having the front edge thereof guided by the conveyance guiding member 6, nothing functions to obstruct the recording medium 3 from being conveyed in the reverse direction. Therefore, higher supportability can be achieved even when the curl correcting unit 15 is provided to the image forming apparatus capable of performing the double-sided image formation.

Figure 7A:
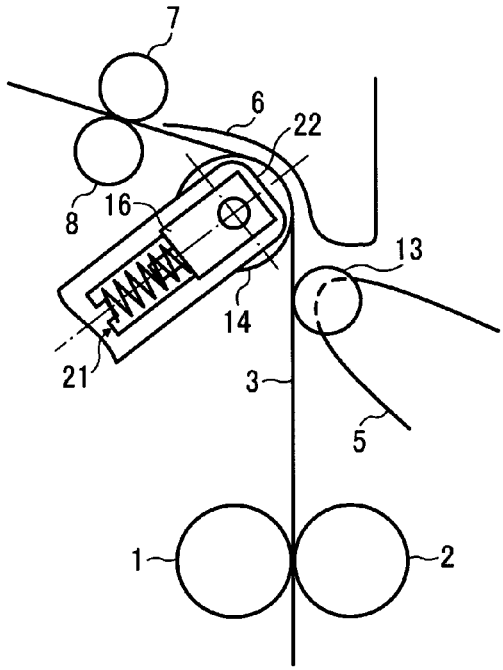
FIG. 7A is a schematic sectional view of an escape mechanism according to an embodiment of the embodiment included in the curl correcting unit while thin paper is processed or nothing is processed.
Figure 7C:
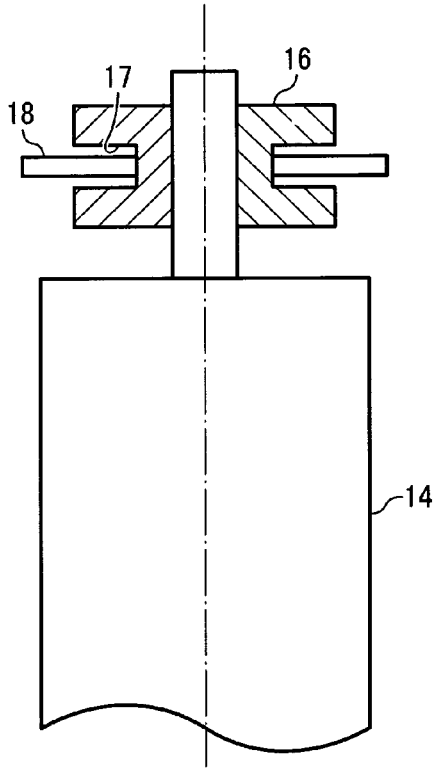
FIG. 7C is a schematic sectional view of a supporting mechanism as an intermediate rotating body arranged on one end of a bending roller.
Figure 7B:
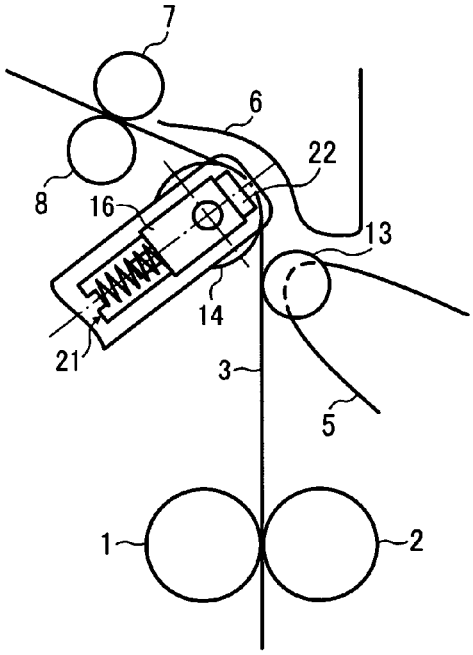
FIG. 7B is a schematic sectional view of the escape mechanism according to the embodiment included in the curl correcting unit while thick paper is processed.

A specific example of the escape mechanism causing the bending roller 14 to escape depending on the rigidity of the recording medium will now be explained with reference to FIGS. 7A to 7C. FIGS. 7A to 7C are schematic for explaining an embodiment of the escape mechanism provided in the curl correcting unit 15. FIG. 7A is a schematic sectional view of the escape mechanism processing thin paper or not processing anything. FIG. 7B is a schematic sectional view of the escape mechanism processing thick paper. FIG. 7C is a schematic sectional view of a supporting mechanism arranged on one end of the bending roller 14.

As illustrated in FIGS. 7A and 7B, the escape mechanism mainly includes a biasing member 21 that applies a biasing force to the bending roller 14 in a direction opposing to the direction in which the bending roller 14 escapes, a bending roller stopper 22 that is an intermediate rotating body stopper that stops the bending roller 14 biased by the biasing member 21 at a predetermined position, and the front edge guiding member 6 that guides the front edge of the recording medium that is guided from the first controlling roller 13 to the ejecting roller 7 and the ejection driven roller 8 by way of its continuous curved form. As it can be seen in the schematic sectional view of one end of the bending roller 14 illustrated in FIG. 7C, the axis of the bending roller 14 is fitted into a bearing portion 16, with both ends thereof held rotatably. A groove 17 is provided to the bearing portion 16. A side plate 18 arranged on the main body of the image forming apparatus is fitted into the groove 17. A cutout is arranged on the side plate 18 in the direction in which the bending roller 14 escapes (for example, in the direction X-Y in FIG. 6) to allow a liner movement of the bending roller 14. As may be seen from FIGS. 7A and 7B illustrating sectional views of the bending roller 14 of the curl correction unit processing thin paper or not processing anything, and processing thick paper, respectively, the bearing portion 16 of the roller axis of the bending roller 14 is biased by means of the biasing member 21, such as a compressed spring, in a direction opposing to the direction in which the bending roller 14 escapes. The bending roller 14 is kept at a predetermined position or the initial position illustrated in FIG. 7A, by way of the bending roller stopper 22 receiving the biasing force of the biasing member 21. When the bending roller 14 escapes in the escape direction upon processing thick paper, as illustrated in FIG. 7B, because the bending roller 14 escapes in the escape direction, that is, the direction toward the cutout on the side plate 18, a space is formed between the bending roller stopper 22 and the bearing portion 16. In the example illustrated, a helical spring is used as the biasing member 21. However, the biasing member 21 is not limited thereto, and may be a leaf spring, as long as such a member is able to excel an appropriate elastic coefficient.

Figure 8A:
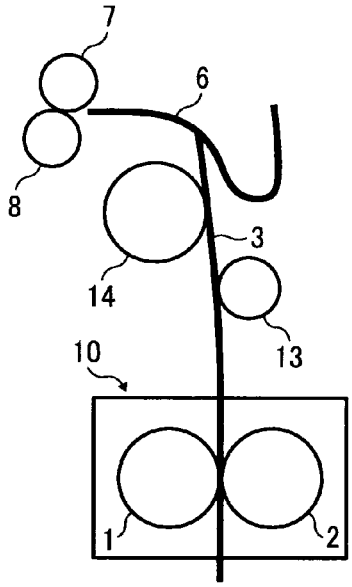
FIG. 8A is a schematic for explaining the concept of an operation in which the bending roller is caused to escape by a contact force of the recording medium contacting to the bending roller, to increase the bent angle θ at the bending roller when a highly rigid recording medium, such as thick paper, is conveyed.
Figure 8B:
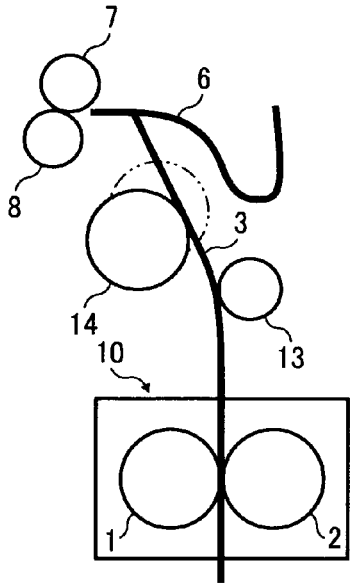
FIG. 8B is another schematic for explaining the concept of the operation in which the bending roller is caused to escape by the contact force of the recording medium contacting the bending roller, to increase the bent angle θ at the bending roller when a highly rigid recording medium, such as thick paper, is conveyed.
Figure 8C:
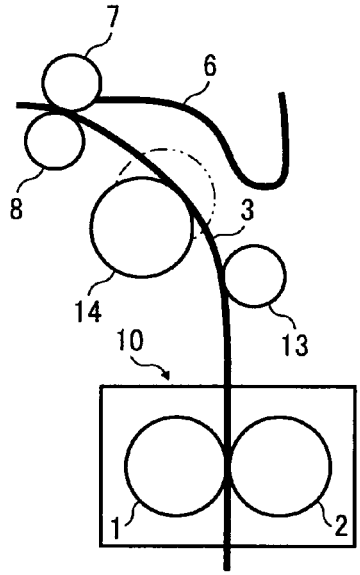
FIG. 8C is another schematic for explaining the concept of the operation in which the bending roller is caused to escape by the contact force of the recording medium contacting the bending roller, to increase the bent angle θ at the bending roller when a highly rigid recording medium, such as thick paper, is conveyed.

An operation performed by the escape mechanism automatically adjusting the bent angle θ based on the rigidity of the recording medium will now be explained with reference to FIGS. 8A to 9C. FIGS. 8A to 8C are schematics for explaining the concept of an operation in which the bending roller 14 is caused to escape by a contact force of the recording medium contacting the bending roller 14, to increase the bent angle θ at the bending roller 14 when a highly rigid recording medium, such as thick paper, is conveyed. FIGS.

9A to 9C are schematics for explaining the concept of an operation in which the bending roller 14 is not caused to escape by the contact force of the recording medium contacting the bending roller 14, without increasing the bent angle θ at the bending roller 14, when a less rigid recording medium, such as thin paper, is conveyed.

FIG. 8A is a sectional view of the curl correcting unit 15 where a surface of the recording medium 3, that is thick paper, is in contact with the bending roller 14, on a side opposing to the side the first controlling roller 13 is in contact with. The driving rotations of the roller pair 1 and 2 in the fixing unit 10 conveys the recording medium 3 being nipped therebetween, and the first controlling roller 13 controls the conveying direction of the recording medium 3. The front edge of the recording medium 3 is kept in contact with and slides along the curved form of the front edge guiding member 6. As a result, the recording medium 3 is brought in contact with the bending roller 14. As illustrated in FIG. 8A, the conveying direction of the recording medium conveyed from the fixing unit 10 is controlled by the first controlling roller 13, so that the front edge thereof is brought in contact with the front edge guiding member 6. The front edge of the recording medium then slides along and guided by the front edge guiding member 6 having a curved form, and a surface of the recording medium is brought in contact with the bending roller 14 on the side opposing to the side that the first controlling roller 13 is in contact with. The recording medium 3, having the conveying direction controlled by the first controlling roller 13 and having its front edge guided by the curved form of the front edge guiding member 6, is brought in contact with the bending roller 14 to excel the contact force corresponding to the rigidity to the bending roller 14. The front edge of the recording medium, which is further conveyed by way of the driving rotation of the fixing roller 1 and the pressing roller 2, is guided by and conveyed along the curved form of the front edge guiding member 6, while both sides thereof in contact with the first controlling roller 13 and the bending roller 14, respectively. As illustrated in FIG. 8B, the elastic coefficient of the biasing member 21 is set so that, when the recording medium is highly rigid, such as in thick paper, the bending roller 14 escapes in a direction to increase the bent angle θ, with the contact point between the first controlling roller 13 and the recording medium working like a fulcrum, because of the large reactive force of the highly rigid recording medium, that is, the large contact force of the recording medium pressing the bending roller 14 toward the escape direction. The recording medium 3 is further conveyed to the ejecting roller 7 and the ejection driven roller 8, having the front edge thereof guided by the front edge guiding member 6, while the bending roller 14 is caused to escape to its escape position. The recording medium is then wound around the bending roller 14 at the bent angle θb to have the curl corrected, while having its conveying direction controlled by the first controlling roller 13 and the ejecting roller 7 and the ejection driven roller 8, as illustrated in FIG. 8C.

Figure 9A:
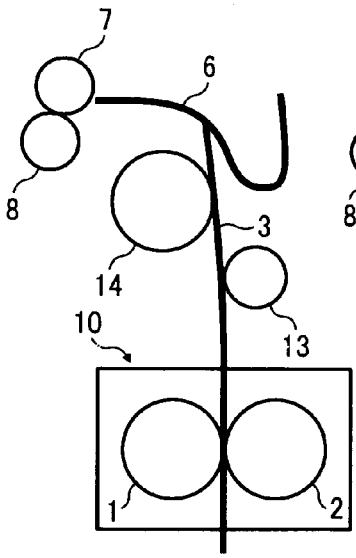
FIG. 9A is a schematic for explaining the concept of an operation in which the bending roller is not caused to escape by the contact force of the recording medium contacting the bending roller, without increasing the bent angle θ at the bending roller, when a less rigid recording medium, such as thin paper, is conveyed.
Figure 9B:
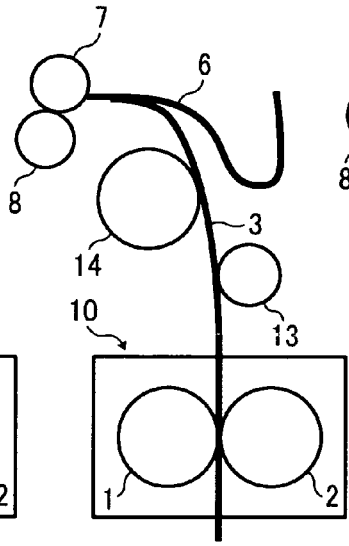
FIG. 9B is another schematic for explaining the concept of the operation in which the bending roller is not caused to escape by the contact force of the recording medium contacting the bending roller, without increasing the bent angle θ at the bending roller, when a less rigid recording medium, such as thin paper, is conveyed.
Figure 9C:
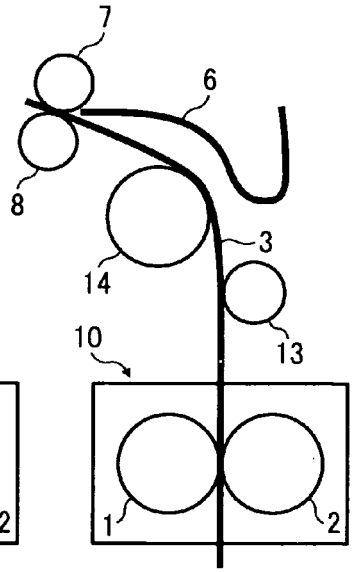
FIG. 9C is another schematic for explaining the concept of the operation in which the bending roller is not caused to escape by the contact force of the recording medium contacting the bending roller, without increasing the bent angle θ at the bending roller, when a less rigid recording medium, such as thin paper, is conveyed.

On the contrary, when the recording medium is thin paper, as illustrated in FIGS. 9A to 9C, the conveying direction of the recording medium conveyed from the fixing unit 10 is controlled by the first controlling roller 13, the front edge of the recording medium is brought in contact with the front edge guiding member 6, and the recording medium comes in contact with the bending roller 14, as illustrated in FIG. 8A, exactly the same manner as for the thick paper illustrated in FIG. 8A. However, because thin paper is less rigid, even when the recording medium comes in contact with the bending roller 14, the elastic coefficient of the biasing member 21 is set so that the recording medium cannot excel enough contact force, that is, reactive force along the direction to compress the biasing member 21 to cause the bending roller 14 to escape, as illustrated in FIG. 9B. In this scenario, the recording medium is bent because the biasing force of the biasing member 21 is greater than the contact force of the recording medium causing the bending roller 14 to escape by way of the reactive force thereof. As a result, the recording medium is conveyed along the front edge guiding member 6. Therefore, the recording medium conveyed thereafter does not cause the bending roller 14 to escape, and have its curl corrected at the bent angle θa initially set, as illustrated in FIG. 8C.

By way of such structures, the bending roller 14 receiving the biasing force of the biasing member 21 and pressed against the bending roller stopper 22 can escape in the escape direction, depending on the contact force applied to the bending roller 14 by means of the rigidity of the conveyed recording medium 3. As a result, because a winding angle θ at which the recording medium is wound around the bending roller 14 can be adjusted automatically according to the rigidity such as the thickness of the recording medium, the degree of a curl can be automatically adjusted.

Figure 10A:
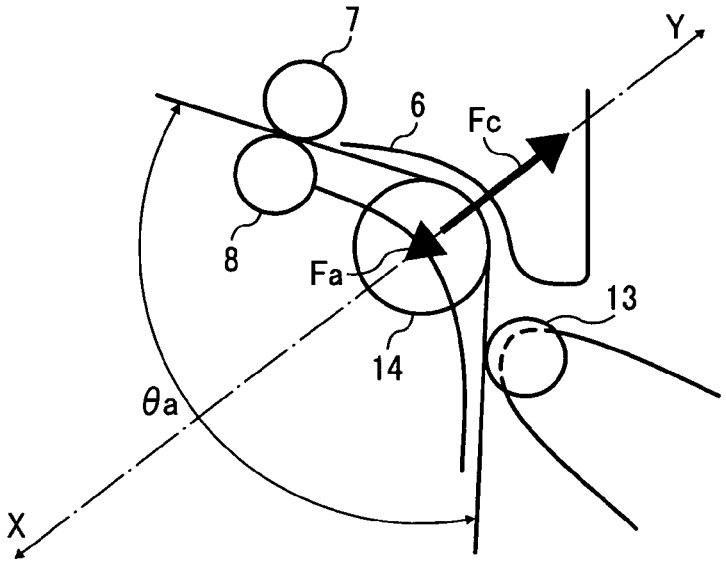
FIG. 10A is a schematic of a force balance between the biasing force of a biasing member arranged in the escape mechanism and a contact force applied to the bending roller based on the rigidity of the recording medium, while thin paper is processed.
Figure 10B:
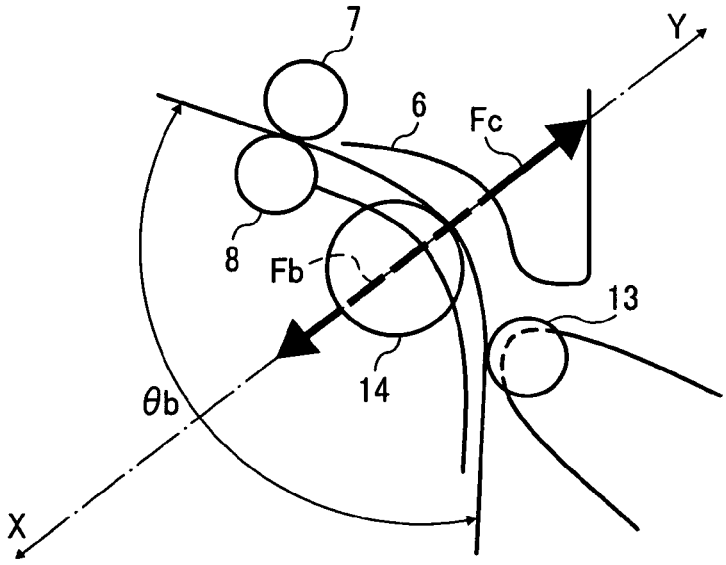
FIG. 10B is a schematic of a force balance between the biasing force of a biasing member arranged to the escape mechanism and the contact force applied to the bending roller based on the rigidity of the recording medium, while thick paper is processed.

A balance between a biasing force Fc of the biasing member 21 and a contact force Fa or Fb applied to the bending roller 14 correspondingly on the rigidity of the recording medium 3, as illustrated in FIGS. 8A to 9C, will now be explained using FIGS. 10A and 10B. FIG. 10A is a schematic of a force balance in processing thin paper, and FIG. 10B is a schematic of a force balance in processing thick paper.

As illustrated in FIG. 10A, the elastic coefficient of the biasing member 21 is set so that the contact force applied in the escape direction of the bending roller 14 by thin paper, having the front edge conveyed along the front edge guiding member 6, that is, the reactive force Fa of the thin recording medium, becomes smaller than the biasing force Fc applied to the bending roller 14 by the biasing member 21. As a result, while thin paper is being processed, a curl of the recording medium is corrected at the bent angle θa, without causing the bending roller 14 to escape in the escape direction. On the contrary, as illustrated in FIG. 10B, the elastic coefficient of the biasing member 21 is set so that the contact force applied to the bending roller 14 by thick paper, having the front edge thereof conveyed along the front edge guiding member 6, that is, the reactive force Fb of the recording medium 3, becomes larger than the biasing force Fc applied to the bending roller 14 by the biasing member 21. As a result, while processing thick paper, the bending roller 14 escapes in the escape direction, and a curl of the recording medium is corrected at the bent angle θb.

Generally, the thicker the recording medium is, that is, the greater the basis weight is, the more rigid the recording medium would be, and as a result, the greater the reactive force of the recording medium would be. Thus, the rigidity of the recording medium can be selected, and the thickness of the recording medium can be set based on a basis weight. In this embodiment, a recording medium having a basis weight less than 120 $g/m^2$ is defined as thin paper, and a recording medium having a basis weight equal to or more than that is defined as thick paper. Based on these definitions, the elastic coefficient of the biasing member 21 is set as to start causing the bending roller 14 to escape when the basis weight of the recording medium exceeds 120 $g/m^2$.

Figure 11A:
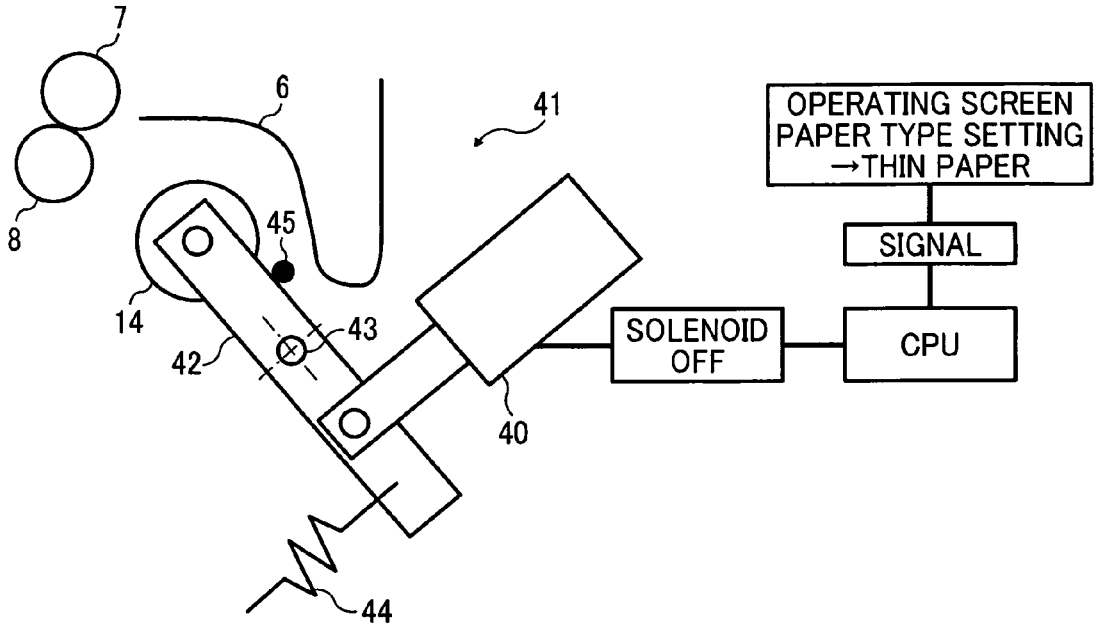
FIG. 11A is a schematic sectional view of an escape mechanism according to another embodiment of the present invention included in the curl correcting unit while thin paper is processed or nothing is processed.
Figure 11B:
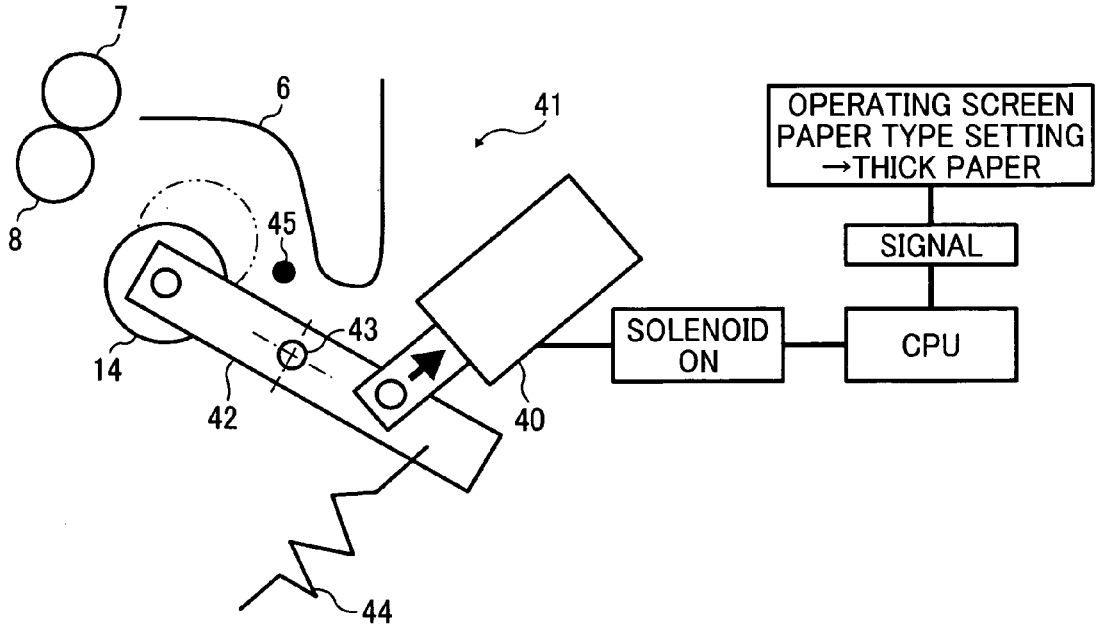
FIG. 11B is a schematic sectional view of an escape mechanism according to the embodiment included in the curl correcting unit while thick paper is processed.

Another example of the escape mechanism will now be explained with reference to FIGS. 11A and 11B. As illustrated in FIGS. 11A and 11B, this escape mechanism includes a solenoid 40, and a linking mechanism 41 to link the power of an operation of the solenoid 40 to the escape of the bending roller 14. In the example illustrated in FIGS. 11A and 11B, one end of a link 42 is connected to the solenoid, and the other end is connected to the axial end of the bending roller 14. The link 42 is rotatable about a link fulcrum 43. A returning spring 44, biased in the direction opposing to the direction of the operation of the solenoid 40, is arranged on the end of the link 42 connected to the solenoid 40 to operate the linking mechanism 41. The link 42 is pulled in a direction opposing to the escape direction of the bending roller 14 by way of the tensile force of the returning spring 44, but kept standby at a predetermined position, in other words, a position for processing thin paper (FIG. 11A) with the bent angle θ set to θa, by way of a link stopper 45.

The solenoid 40 is configured so that, when the solenoid 40 is operated, the link 42 can be rotated about the link fulcrum 43 against the tensile force of the returning spring 44, bringing the bending roller 14 to the escape position illustrated in FIG. 11B, that is, a position at which thick paper is processed with the bent angle θ set to θb. The solenoid 40 can be operated when a user sets or selects a type of a recording medium on an operating screen provided to the main body of the image forming apparatus, via a controller (central processing unit (CPU)) of the main body of the image forming apparatus, in the manner illustrated in FIGS. 11A and 11B.

In the example illustrated in FIGS. 11A and 11B, the operation of the solenoid 40 is linked to the escape operation of the bending roller 14 simply by using the link 42 rotating about the link axis. However, the present invention is not limited thereto, and the operation of the solenoid 40 may be linked to the escape operation of the bending roller 14 using another link not illustrated. In other words, the linking mechanism 41 may be provided with appropriate structures by considering arrangements and positioning upon designing the image forming apparatus, for example. Furthermore, the returning spring 44 may be omitted by making the solenoid 40 a bidirectional solenoid. In such a scenario, a predetermined pressure should be applied by using a magnet, for example, so that the bending roller 14 does not escape from the predetermined position illustrated in FIG. 11A upon processing thin paper, that is, the bent angle θa does not escape by the contact force of the recording medium against the bending roller 14.

In such a structure as well, the bent angle θ can be increased upon processing thick paper, by causing the bending roller 14 to escape. In this manner, the object of the present invention is achieved in the same manner as in the embodiment by using the biasing member 21. In this embodiment as well, a recording medium having a basis weight less than 120 g/m$^2$ may be defined as thin paper, and a recording medium having a basis weight equal to or more than that may be defined as thick paper, in the same manner as described above for the escape mechanism according to the previous embodiment. In other words, in the escape mechanism using a solenoid as illustrated in FIGS. 11A and 11B, when the basis weight of the recording medium exceeds 120 g/m$^2$, the user can select thick paper on the operating screen so that the bending roller 14 is caused to escape.

Figure 12:
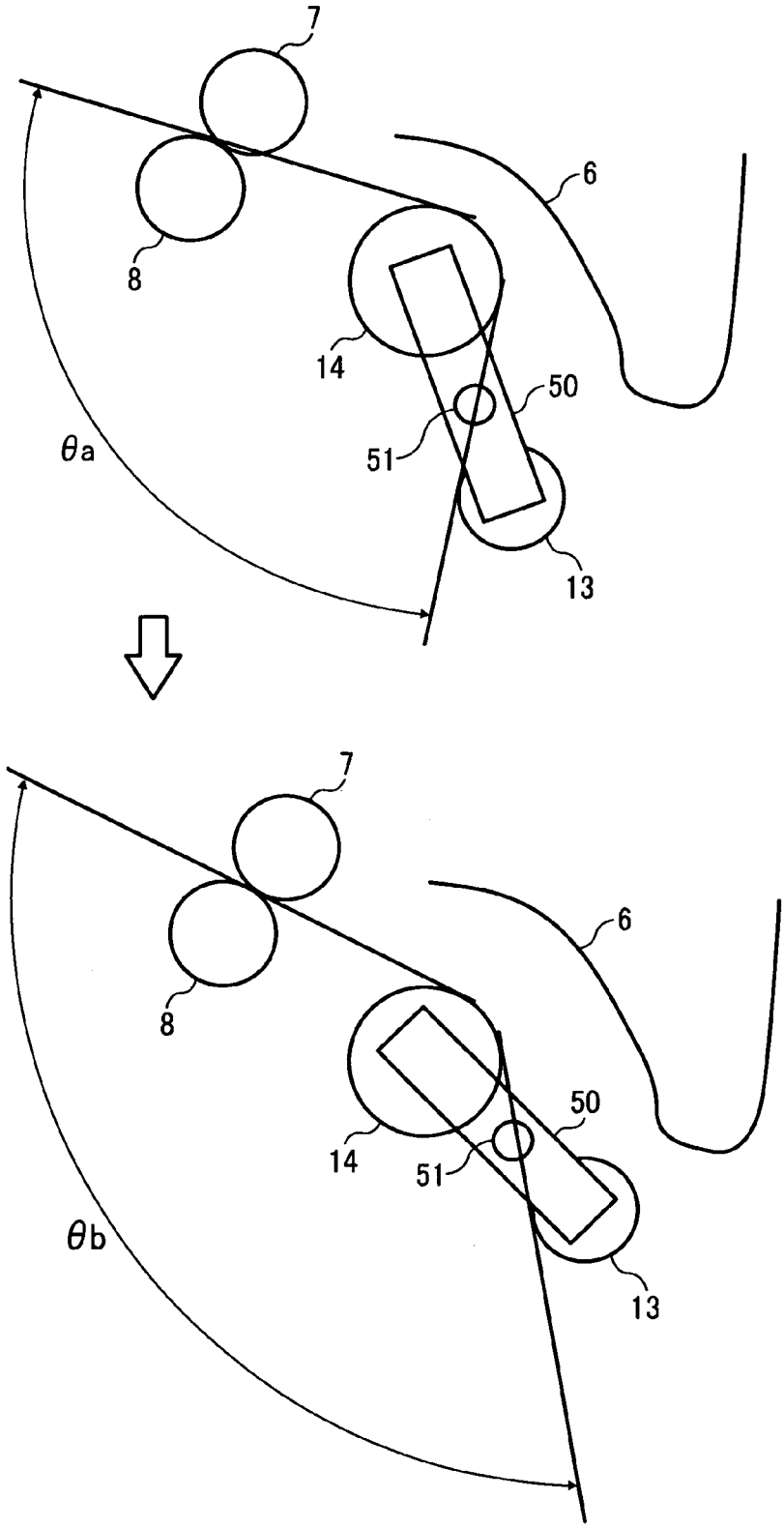
FIG. 12 is a schematic sectional view of an escape mechanism according to another embodiment included in the curl correcting unit according to the embodiment.

Another embodiment of the escape mechanism will now be explained with reference to FIG. 12. As illustrated in FIG. 12, in an escape mechanism according to this embodiment, when the bending roller 14 escapes to increase the bent angle θ from θa to θb, the first controlling roller 13 operates in conjunction with the operation of the escape mechanism, so that the first controlling roller 13 operates to increase the bent angle θ further.

In the example illustrated in FIG. 12, the roller axis or the rotating axis of the bending roller 14 and the roller axis or the rotating axis of first controlling roller 13 are respectively connected to both ends of a link 50, and the link 50 is rotated about a link fulcrum 51, so that the bent angle θ is increased in a greater degree than that achieved when the bending roller 14 alone is operated. Because the first controlling roller 13 operates in conjunction with the escape operation of the bending roller 14, upon processing thick paper, the degree at which the initial bent angle θa is increased to θb can be set more prominently. Furthermore, by way of such a structure, assuming that the degree at which the bent angle is increased from θa to θb is the same as in causing only the bending roller 14 to escape, the degree by which the bending roller 14 itself escapes can be reduced. Therefore, it is more preferable because the elastic coefficient of the biasing member 21, the operating distance of the solenoid 40, or the installed position of the escape mechanism can be designed more freely, for example.

Such a structure, in which the first controlling roller 13 operates in conjunction in a direction to further increase the bent angle θ upon escaping the bending roller 14, can also be applied to the embodiment using the biasing member 21, or to the embodiment causing the bending roller 14 to escape by using the solenoid 40 described above.

Finally, in all of the embodiments described above, the rotation of the first controlling roller 13 can be driven by the driving rotations of the ejecting roller 7 and the ejection driven roller 8. In driving the first controlling roller 13, a dedicated driving source may be provided to the first controlling roller 13 to synchronize the rotation thereof with the driving rotations of the ejecting roller 7 and the ejection driven roller 8 by means of the controller provided in the main body of the image forming apparatus. Alternatively, the rotating energy of the ejecting roller 7 and the ejection driven roller 8 can be linked to the rotation of the first controlling roller 13, using a belt or a belt pulley around which such a belt is wound. In this manner, by driving the first controlling roller 13 to rotate by the driving rotations of the ejecting roller 7 and the ejection driven roller 8, the conveying force can be communicated to the recording medium more effectively. Therefore, it is suitable for applying an appropriate conveying force to the recording medium 3. Furthermore, in all of the embodiments described above, the ejecting roller 7 and the ejection driven roller 8 included in the curl correcting unit 15 is explained to function as the ejecting roller pair 7 and 8 illustrated in FIG. 1 as well. However, the present invention is not limited thereto, and the ejecting roller 7 and the ejection driven roller 8 can be arranged separately from the ejecting roller pairs. In other words, when a recording medium conveying path continues further down from the curl correcting unit 15, the ejecting roller 7 and the ejection roller 8 may be provided as a conveying roller pair for conveying the recording medium, and the ejection roller pair can be provided as a separate roller pair in the downstream thereof in the conveying direction.

According to the present invention, because a curl of a recording medium is corrected by winding the recording medium around the intermediate rotating body using the first rotating body and the second rotating body pair, the curl can be corrected without reducing the curvature radius of the recording medium while correcting the curl. Furthermore, by causing the intermediate rotating body to escape in the direction to increase the bent angle depending on the rigidity of the recording medium, a curl of the recording medium can be automatically corrected in the manner appropriate for the rigidity of the recording medium. As a result, a less curled recording medium can be obtained, regardless of a type of the recording medium, especially regardless of the thickness type of the recording medium. Furthermore, because the intermediate rotating body is caused to escape in the direction to increase the bent angle for the recording medium, upon conveying a highly rigid recording medium, such as thick paper, the load of conveying the recording medium can be reduced. Therefore, it is possible to provide a conveyer that is capable of conveying the recording medium appropriately, without causing jamming in conveying the recording medium, as well as maintaining an appropriate conveying force by means of the second rotating body pair. Furthermore, even if the recording medium is conveyed in the reverse direction into the conveyer according to the present invention, nothing functions to obstruct the recording medium from being conveyed in the reverse direction. Therefore, higher supportability can be achieved even when the conveyer is arranged in a conveying path for double-sided image formation.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A conveyer comprising:

a first rotating body that controls a direction in which a recording medium is conveyed;

a second rotating body pair that is arranged downstream of the first rotating body in the direction in which the recording medium is conveyed, and conveys the recording medium while controlling the direction in which the recording medium is conveyed; and an intermediate rotating body arranged between the first rotating body and the second rotating body pair, and being in contact with the recording medium on a side opposing to another side with which the first rotating body is in contact, wherein a front edge guiding member that guides a front edge of the recording medium conveyed from the first rotating body to the second rotating body pair by sliding the recording medium, the intermediate rotating body does not contact the front edge guiding member, the recording medium is wound around and bent by the intermediate rotating body at a bent angle formed by a tangent line shared by the intermediate rotating body and the first rotating body, and a secondary line on which such a tangent line of the intermediate rotating body is connected to a nip point of the second rotating body pair, and the intermediate rotating body includes an escape mechanism that is capable of causing the intermediate rotating body to escape in a direction to increase the bent angle depending on rigidity of the recording medium.

2. The conveyer according to claim 1, wherein the escape mechanism includes a biasing member that applies a biasing force in a direction opposing to the direction to which the intermediate rotating body escapes, an intermediate rotating body stopper that keeps the intermediate rotating body biased by the biasing member at a predetermined position, wherein the biasing member causes the intermediate rotating body to escape by way of a contact force of the recording medium to the intermediate rotating body depending on rigidity of the recording medium whose front edge conveyed by the front edge guiding member.

3. The conveyer according to claim 2, further comprising:

a facing guiding member that faces and forms a pair with the front edge guiding member to guide conveyance of the recording medium, while forming a conveying path for the recording medium, wherein the intermediate rotating body is arranged in the facing guiding member.

4. The conveyer according to claim 1, wherein, upon causing the intermediate rotating body to escape in the direction to increase the bent angle, the first rotating body operates in conjunction with the escape movement.

5. The conveyer according to claim 1, wherein the escape mechanism is set to cause the intermediate rotating body to escape when a recording medium having a basis weight equal to or more than 120 $g/m^2$ is being conveyed.

6. The conveyer according to claim 1, wherein the escape mechanism includes a solenoid, and a linking mechanism that links power of an operation of the solenoid to escape movement of the intermediate rotating body in a direction to increase the bent angle.

7. The conveyer according to claim 1, wherein the intermediate rotating body escapes in a direction dividing the bent angle into two halves.

8. The conveyer according to claim 1, wherein rotation of the first rotating body is driven by driving rotations of the second rotating body pair.

9. An image forming apparatus including a conveyer arranged downstream of a fixing unit in a conveying direction, the conveyer comprising:

a first rotating body that controls a direction in which a recording medium is conveyed;

a second rotating body pair that is arranged downstream of the first rotating body in the direction in which the recording medium is conveyed, and conveys the recording medium while controlling the direction in which the recording medium is conveyed; and an intermediate rotating body arranged between the first rotating body and the second rotating body pair, and being in contact with the recording medium on a side opposing to another side with which the first rotating body is in contact, wherein a front edge guiding member that guides a front edge of the recording medium conveyed from the first rotating body to the second rotating body pair by sliding the recording medium, the intermediate rotating body does not contact the front edge guiding member, the recording medium is wound around and bent by the intermediate rotating body at a bent angle formed by a tangent line shared by the intermediate rotating body and the first rotating body, and a secondary line on which such a tangent line of the intermediate rotating body is connected to a nip point of the second rotating body pair, and the intermediate rotating body includes an escape mechanism that is capable of causing the intermediate rotating body to escape in a direction to increase the bent angle depending on rigidity of the recording medium.

* * * * *